United States Patent [19]

Rosen

[11] Patent Number: 4,974,262

[45] Date of Patent: Dec. 4, 1990

[54] HINGE FOR TOILET SEAT AND LID

[75] Inventor: Maurice M. Rosen, Bryn Mawr, Pa.

[73] Assignee: Ginsey Industries, Inc., Bellmawr, N.J.

[21] Appl. No.: 217,628

[22] Filed: Jul. 11, 1988

[51] Int. Cl.[5] ..... A47K 13/12

[52] U.S. Cl. ..... 4/236; 4/240

[58] Field of Search ..... 4/236, 240, 234, 235, 4/237, 238, 239, 241, 248; 16/382, 383, 384, 388

[56] References Cited

U.S. PATENT DOCUMENTS

| | | | |
|---|---|---|---|
| 1,051,508 | 1/1913 | Miller | 4/248 |
| 2,873,454 | 2/1959 | Phillips | 4/248 |
| 3,046,570 | 7/1962 | Young | 4/240 |
| 3,184,874 | 5/1965 | Schoenfield | 40/301 |
| 3,252,179 | 5/1966 | Watson | 16/128 |
| 3,301,121 | 1/1967 | Newcomber | 85/1 |
| 3,308,483 | 3/1967 | Miller | 4/336 |
| 3,360,835 | 1/1968 | Foertmeyer | 24/90 |
| 3,377,633 | 4/1968 | Waldron | 4/236 |
| 3,550,164 | 12/1970 | Pease | 4/236 |
| 3,557,393 | 1/1971 | Waldron | 4/236 |
| 3,665,552 | 5/1972 | Toldo | 4/236 |
| 3,689,962 | 9/1972 | Erickson | 24/108 |
| 3,725,980 | 4/1973 | Burgio | 24/108 |
| 3,820,175 | 6/1974 | Waldon | 4/236 |
| 3,892,013 | 7/1975 | Gould | 24/90 |
| 3,925,855 | 12/1975 | Olovson | 74/90 |
| 3,949,432 | 4/1976 | Ginsburg | 4/237 |
| 3,967,348 | 7/1976 | Rogen | 24/90 |
| 4,159,548 | 7/1979 | Hewson | 4/236 |
| 4,173,802 | 11/1974 | Wikstrom | 4/240 |
| 4,194,272 | 3/1980 | Taffurelli | 24/90 |
| 4,248,646 | 2/1981 | Ginsburg | 156/78 |
| 4,314,382 | 2/1982 | Ginsburg | 4/236 |
| 4,319,365 | 3/1982 | Bemis | 4/236 |
| 4,326,307 | 4/1982 | Baillie et al. | 4/236 |
| 4,398,307 | 3/1983 | Ginsburg | 7/236 |
| 4,467,481 | 8/1984 | Ginsburg | 4/240 |

FOREIGN PATENT DOCUMENTS

| | | | |
|---|---|---|---|
| 1801347 | 5/1969 | Fed. Rep. of Germany | 2/240 |
| 358565 | 1/1962 | Switzerland | 4/240 |

*Primary Examiner*—Ernest G. Cusick
*Assistant Examiner*—Edward C. Donovan
*Attorney, Agent, or Firm*—Paul & Paul

[57] ABSTRACT

A hinge for a toilet seat and lid includes a bowl leaf, a seat leaf and a lid leaf. The bowl leaf includes a base, means for securing the bowl leaf to a toilet bowl, and a pair of spaced socket portions extending upwardly from the forward end of the bowl leaf base. The seat leaf has a base for securing the seat leaf to a toilet seat, and a hinge pin receiving member extending upwardly from the rear end of the base and having an aperture formed therein for receiving a pair of hinge pins. The lid leaf includes a base, means for securing a lid leaf to a toilet seat lid, and a pair of hinge pin supports extending downwardly from the rear portion of the base. Each hinge pin support as a pair of hinge members extending laterally in opposite directions. The slot extends generally upwardly and rearwardly in the hinge pin receiving member. A hinge pin retaining member extends from one of the walls of the slot. The hinge pin retaining member has a generally concave interior surface and a generally triangular cross section and serves to securely retain the hinge pins within the slot while speeding assembly of the hinge.

8 Claims, 4 Drawing Sheets

HINGE FOR TOILET SEAT AND LID

BACKGROUND OF THE INVENTION

Field of the Invention

This invention relates generally to cushioned toilet seats, and more specifically to composite hinges having three arms or leaves, one each for attachment to the porcelain bowl, to the cushioned toilet seat, and to the lid.

Typically, cushioned toilet seats include a rigid annular support member of wood or plastic and an annular cushion of foam plastic which rests on and is supported by the rigid annular support member. Both members of the seat are typically encased in a decorative flexible film, often chosen to coordinate with the color of the bowl or other elements of the bathroom decor. The lid also may be constructed using a rigid generally flat base covered on the top with a plastic foam member and encased with a decorative plastic film. Cushioned toilet seats are disclosed, for example, in U.S. Pat. Nos. 3,949,432 and 4,248,646. Alternatively, either the lid or the seat or both can be molded from a suitable plastic material, such as a foamed plastic material. The foam cushion of the seat can vary in thickness as, for example, from 1 inch or less to 2 inches or more.

The seat and lid are typically mounted at the top rear of the bowl by a pair of hinges which permit either the lid or both the lid and the seat to be rotated from the horizontal position in which the seat is supported by the bowl rim and the lid by the seat to a generally vertical position. It desirable that the hinges hold the seat and lid securely on the bowl yet also permit the seat and lid to be easily and quickly mounted on a variety of different types of bowls which may be provided with hinge mounting holes located in different positions. Preferably the hinge is of a simple, easily cleanable design, and formed from a tough and readily cleanable material. It is also desirable to minimize the number of steps required to assemble the hinge when manufactured. High for toilet seats and lids are disclosed, for example, in U.S. Pat. Nos. 4,467,481, 4,398,307 and 4,314,382.

U.S. Pat. No. 4,398,307 discloses a toilet seat hinge having seat, lid, and bowl leafs, the lid leaf having a pair of downwardly and rearwardly directed legs from which laterally extend pairs of hinge pins. The inwardly extending hinge pins extend within recesses in a forwardly directed upright portion of the seat leaf, while the outwardly extending hinge pins extend within recesses formed in a pair of upwardly directed arms of the bowl leaf. When the lid leaf and seat leaf are assembled together, a wedge formed on the rearward edge of the seat leaf upright is used to cam apart the legs of the lid leaf, so that the inwardly extending hinge pins to snap into the recesses in the seat leaf upright.

SUMMARY OF THE INVENTION

The present invention provides an improved hinge for a toilet seat and lid which permits the seat and lid to be quickly and securely assembled together and subsequently readily mounted to a bowl. The hinge of the present invention permits a toilet seat lid and cover to be easily and quickly mounted to bowls having mounting holes located in any of a variety of positions, an especially important consideration when the seat and lid are to replace worn, damaged, or uncomfortable seats provided by the bowl manufacturer. In addition, the present invention permits the hinge to be manufactured with readily cleanable exterior surfaces and for the seat, lid and hinge assembly to be quickly and easily removed from the bowl for more thorough cleaning if desired.

The hinge of the present invention in an improvement of the hinge disclosed in U.S. Pat. No. 4,398,307. The present invention comprises a bowl leaf having a base, means for securing the bowl leaf to a toilet bowl, and a pair of spaced apart socket portions extending upwardly from the forward end of the bowl leaf base. In addition, the hinge comprises a seat leaf having a base, means for securing the seat leaf to a toilet seat, and a hinge pin receiving member extending upwardly from the rear end of the base and having a slot formed therein for receiving a fair of hinge pins as well as a hinge pin retaining member. The hinge further comprises a lid leaf having a base, means for securing the lid leaf to a toilet seat lid, and a pair of hinge pin supports extended downwardly from the rear portion of the base, each hinge pin support having a pair of hinge pins extending laterally in opposite directions therefrom. The slot and retaining member in the hinge pin receiving member facilitate assembly of the seat and lid leafs.

DETAILED DESCRIPTION OF THE PREFERRED EMBODIMENTS

Figure 1:
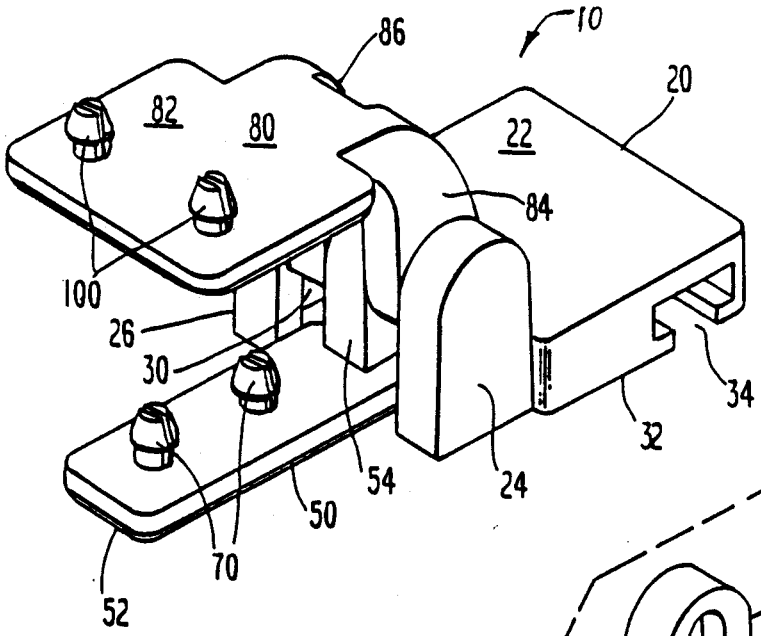
FIG. 1 is a perspective view of an embodiment of a hinge according to the present invention.

Referring now to the drawings in detail, wherein like reference numerals indicate like elements in each of the several views, reference is first made to FIG. 1, where a hinge 10 according to the present invention for a toilet seat and lid (not shown) is illustrated in a closed position. The hinge 10 includes a rear or bowl arm or leaf 20 adapted to be attached to a toilet bowl, a lower forwardly extending seat arm or leaf 50 adapted to be attached to the underside of the toilet seat at the rearward end thereof and a forwardly extending upper lid arm or leaf 80 adapted to be attached to the underside of the toilet seat lid at the rearward end thereof.

The leafs 20, 50, 80 are preferably formed from a resilient, durable, readily cleanable plastic material such as acrylonitrile-butadiene-styrene (ABS) plastic or the like by injection molding or a like process. If desired, suitable coloring can be included in the injection molding compound to provide a hinge 10 having a color coordinated with the color of the toilet seat and lid which are to be mounted.

Bowl leaf 20 includes a bowl leaf base 22 which can assume a generally flat rectangular configuration as shown in FIG. 1. A generally T-shaped slot 34 is formed in the bottom 32 of the bowl leaf base 22 for mounting the hinge 10 to the bowl. The bowl leaf 20 also includes a pair of spaced uprights or socket portions 24, 26 (best seen in FIG. 2) at the forward end thereof each having an open ended inwardly facing slot 28, 30 for a purpose to be described. The socket portions 24, 26 are integrally formed with the bowl leaf base 22.

The lower forwardly extending seat arm or leaf 50 has an elongated base 52 as well as a vertical upright portion or member 54 integrally formed with the base 52. The vertical upright member 54 has a aperture or slot 56 formed therein for a purpose to be described. The forwardly extending base 52 has a pair of split compressible prongs or studs 70 extending from the upper surface thereof and which are adapted to be press fitted into holes or apertures formed or drilled in the under surface of a seat 14 (as best seen in FIG. 4) to secure the seat 14 to the hinge 10.

The lid leaf 80 (best seen in FIG. 3) includes a generally flat, generally rectangular lid leaf base 82 from which downwardly and rearwardly extend a spaced, parallel pair of hinge pins supports 84, 86 from the rear of the lid leaf base 82. Each hinge pin support 84, 86 has a pair of hinge pins 88, 90, 92, 94 extending laterally in opposite directions therefrom, all the hinge pins 88, 90, 92, 94 having a common axis 98. Each of the two hinge pins supports 84, 86 has one outwardly directed hinge pin 88, 94 and one inwardly directed hinge pin 88, 90. The hinge pins 88, 90, 92, 94 are generally cylindrical and have generally flat faces. The faces of the two inwardly directed hinge pins 90, 92 are separated by a space 96 for a purpose to be described.

Figure 4:
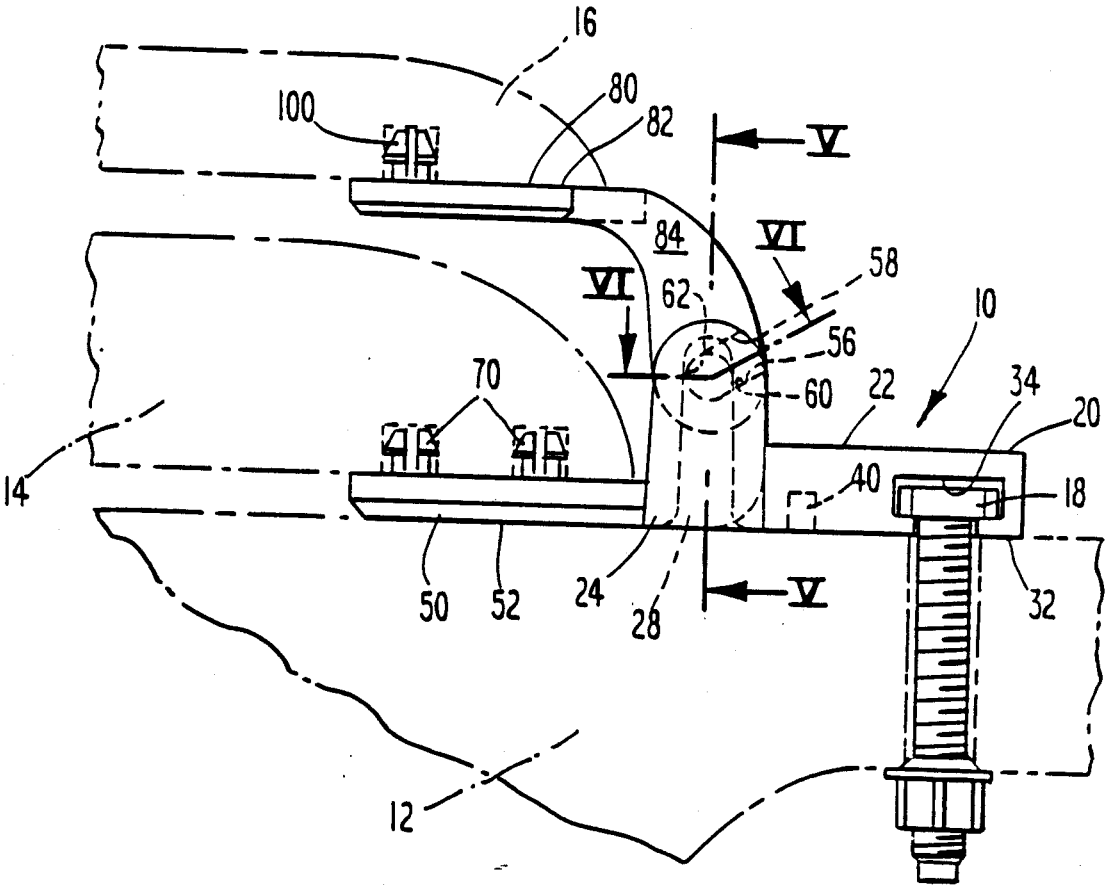
FIG. 4 is a side elevational view of one of the hinges of FIG. 3 taken along the line IV—IV and depicting the hinge in the closed position.

The upper surface of the lid leaf base 82 has a pair of split compressible prongs or studs 100 which are adapted to be press fitted into holes formed or drilled in the other surface of a lid 16, as shown in FIG. 4, to secure the lid 16 to the hinge 10.

Figure 2:
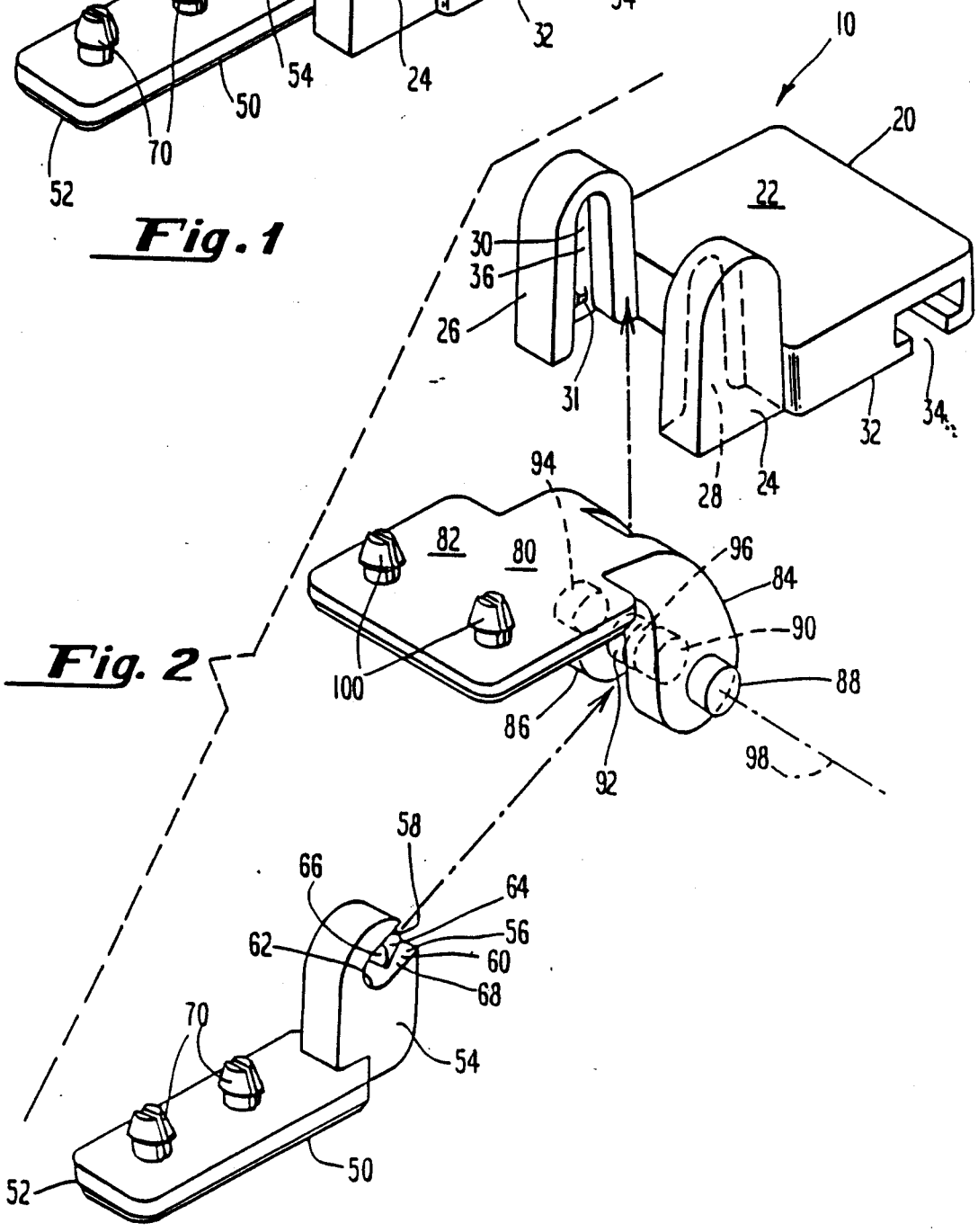
FIG. 2 is an exploded perspective view of the hinge of FIG. 1.
Figure 6:
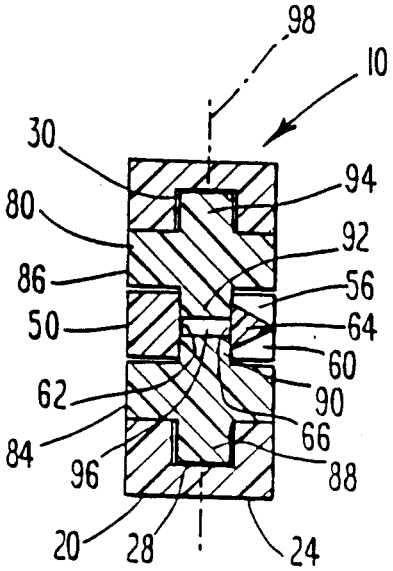
FIG. 6 is a sectional view of the hinge of FIG. 4 taken along the line VI—VI.

The aperture or slot 56 formed in the upwardly directed member 54 of the seat leaf 50 is adapted to receive and contain the inwardly directed hinge pins 90, 92 of the lid leaf 80. As best seen in FIGS. 2 and 4, the slot 56 is formed in the upright or hinge pin receiving number 54 so that the slot 56 is generally rearwardly and upwardly directed. The slot 56 is bounded by upper and lower generally flat walls 58, 60 and a generally concave interior wall 62 continuous therewith. Extending from the upper wall 58 of the slot 56 is a hinge pin retaining portion 64 (best seen in FIGS. 2, 3 and 6). The hinge pin retaining portion 64 has a generally concave interior wall 66 continuous with the generally concave interior wall 62 of the slot 56. The interior walls 62, 66 or the slot 56 and the retaining portion 64 form a portion of a generally cylindrical surface, the radius of the generally cylindrical surface being selected so that the generally cylindrical inwardly directed hinge pins 90, 92 are securely but rotatively held when positioned therewithin.

The hinge pin retaining portion 64 has a generally triangular cross section (FIGS. 3 and 6) in a plane perpendicular to the interior wall 66 of the retaining portion 64. A hinge pin receiving passageway 68 separates the hinge pin retaining portion 64 from the lower or bottom wall 60 of slot 56. The seat leaf 50 is assembled with the lid leaf 80 by pressing the inwardly directed hinge pins 90, 92 into the hinge pin receiving slot 56. As the seat leaf 50 and lid leaf 80 are pressed together, the sides of the triangular hinge pin retaining portion 64 push or cam apart the hinge pins supports 84, 86 until the inwardly directed hinge pins 90, 92 are centered within the interior walls 62, 66 of the slot 56 and hinge pin retaining portion 64, at which point the resilient hinge pin supports 84, 86 return to their initial orientation. Thus, the seat leaf 50 and lid leaf 80 can be quickly and easily assembled together. The assembly of the seat and lid leafs of the present invention is easier than that of the seat and lid leafs of the hinge of U.S. Pat. No. 4,390,307 because the hinge pins track the slot before they engage and are separated by the retaining member and snap immediately into place thereafter. The compressive force required for assembly is believed to be less than that required to assemble the seat and lid leafs of the hinge of U.S. Pat. No. 4,398,307 because the inwardly extending hinge pins need not be spread apart as far to assemble the hinge of the present invention.

Figure 5:
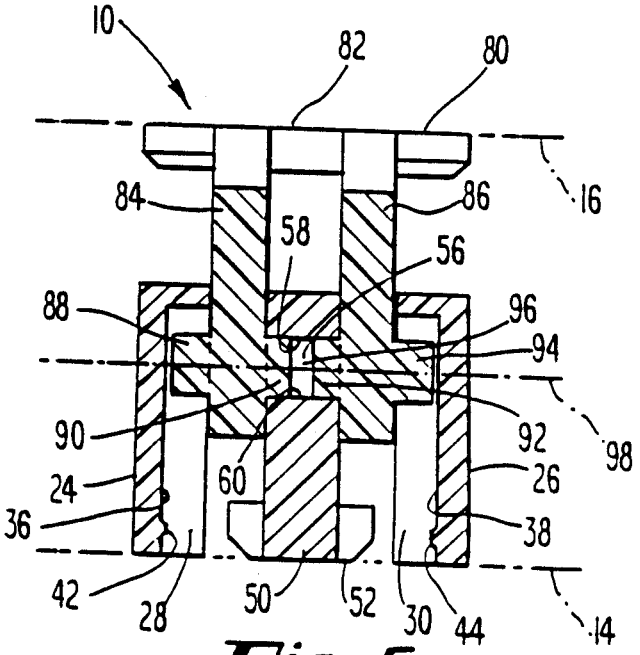
FIG. 5 is a sectional elevational view of the hinge of FIG. 4 taken along the line V—V.

The bowl leaf 20 and lid leaf 80 can be assembled together next. The inwardly directed slots 28, 30 of the socket portions 24, 26 of the bowl leaf 20 can be placed over the outwardly directed hinge pins 88, 94. The slots 28, 30 have generally flat inner faces 36, 38 (FIG. 5) which are generally parallel and spaced by a distance slightly greater than the distance along the hinge pin axis 98 between the faces of the outwardly directed hinge pins 88, 94. Inwardly directed protrusions or dimples 42, 44 are formed proximate the bottoms of the inner faces 36, 38 of the slots 28, 30 to retain the hinge pins 88, 94 within the slots 28, 30 after the hinge 10 has been assembled.

After the bowl leaf 20, the set leaf 50 and the lid leaf 80 have been assembled together, the resulting hinge 10 can be assembled with a seat and a lid to form a toilet seat/lid assembly 110 which can be packaged and shipped for subsequent installation. As best seen in FIG. 2, the studs 100 of the lid leaf 80 can lie in a line generally parallel the hinge pin axis 98 and the studs 70 of the seat lid 50 can lie in a line generally perpendicular to the hinge pin axis 98.

Figure 3:
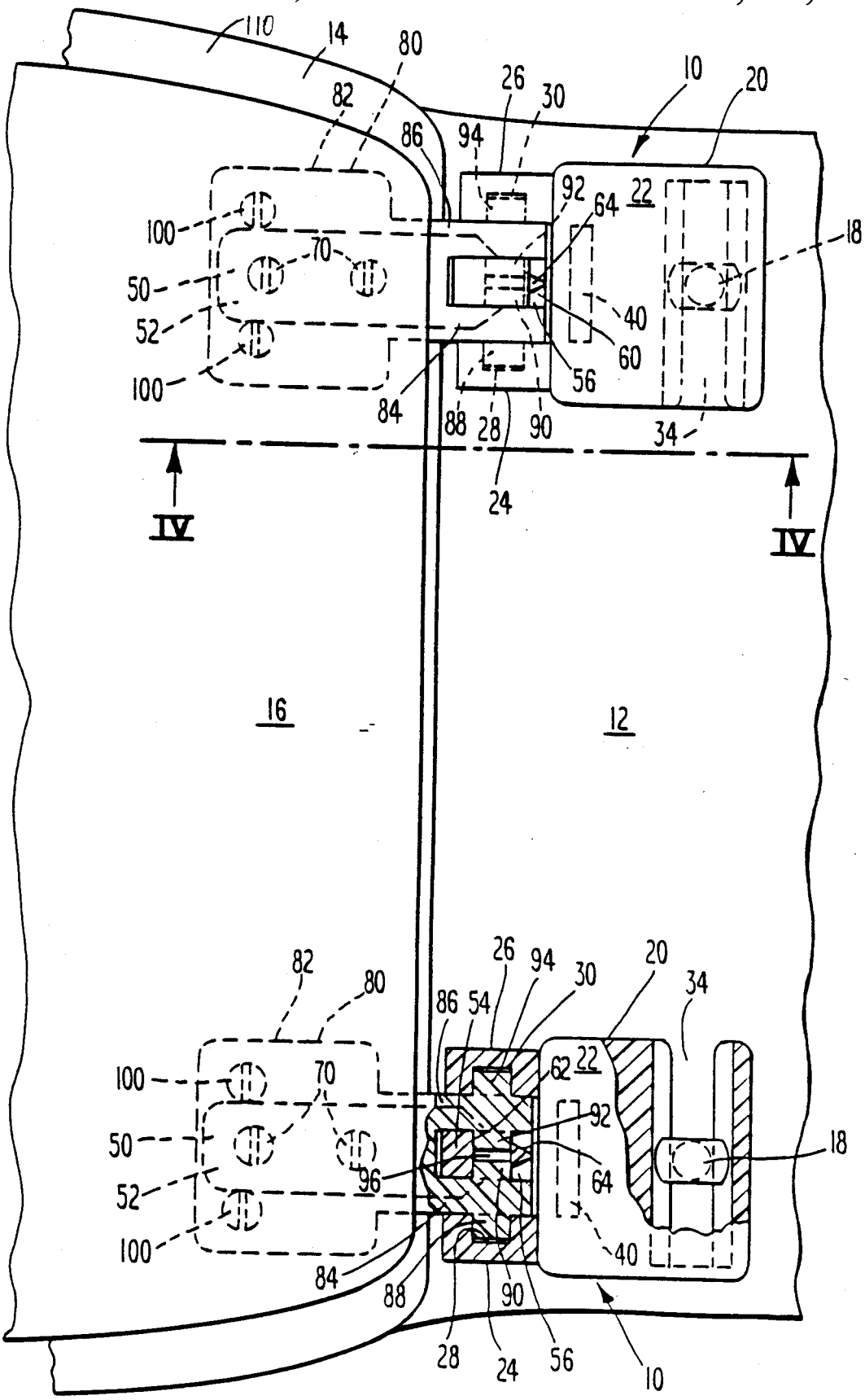
FIG. 3 is a top plan view of a pair of the hinges shown in FIGS. 1 and 2 shown mounting a toilet seat and toilet seat lid to a bowl, one of the hinges being shown partially in section.

As best seen in the plan view of FIG. 3, the T-shaped slot 34 opens on one side of the leaf base 22 and is closed at the other side of the leaf base 22, permitting the hinge 10 to be installed by slipping the bowl leaf base 22 over the head of a fastening member or bolt 18. After the hinge has been fitted onto the head of the fastening member 18, the fastening member 18 can be inserted in a preformed aperture in a bowl 12 (FIG. 4) and the fastening member 18 can be tightened to securely mount the hinge 10 to the bowl 12. Preferably, the fastening member 18 has an elongated head as best seen in FIG. 3. The fastening member 18 can include a bolt portion and a nut portion, each preferably submitted as described below from a tough, resilient, rust-proof material such as high density polyethylene.

When a pair of hinges 10 have been previously attached to a toilet seat 14 and toilet seat lid 16, the fastening members 18 can be loosely installed in the bowl 12 and the elongated heads of the fastening members 18 can be oriented parallel to the T-shaped slots 34. The assembly including the seat 14, lid 16 and hinges 10 can then be placed on the bowl 12 so that the T-shaped slots overlie the heads of the fastening members 18. Each fastening member 18 can then be pushed upward and the head rotated by 90° so that the underside of the head will engage the shoulder formed in the T-shaped slot 34 when the fastening member 18 is tightened.

If desired, the bowl leaf base 22 can be provided with a second T-shaped slot (not shown) positioned parallel to and spaced forward from the illustrated T-shaped slot 34. The second T-shaped slot provides additional flexibility in mounting the hinge 10 to a bowl 12. The height or thickness of the forwardly extending base 52 of the seat leaf 50 is preferably equal to the height or thickness of the bumpers (not shown) which are ordinarily provided on the undersurface of the toilet seat.

Figure 7:
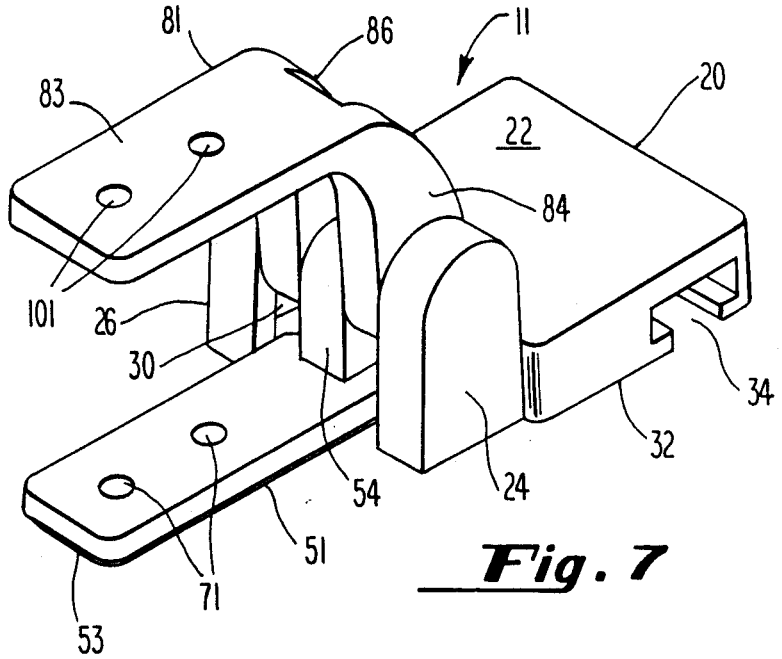
FIG. 7 is a perspective view of another, presently preferred embodiment of a hinge according to the present invention.
Figure 8:
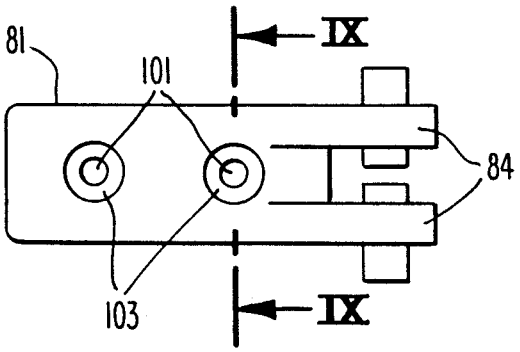
FIG. 8 is a bottom plan view of the lid leaf of the hinge of FIG. 7.
Figure 9:
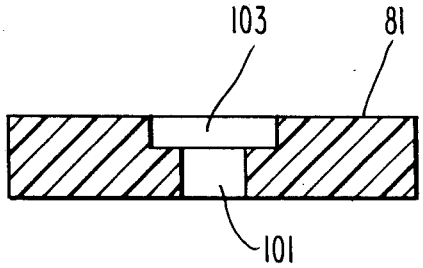
FIG. 9 is a sectional elevational view of the lid leaf of FIG. 8 taken along the line IX—IX.

A second embodiment of a hinge 11 according to the present invention is illustrated in FIGS. 7–9. FIG. 7 is a perspective view of the hinge 11, which includes a lid leaf 81 having an elongated, generally rectangular base 83. The base has a pair of apertures 101 formed therein for receiving fastening members, such as wood screws, for securing the lid leaf 81 to a toilet seat lid (not shown). The hinge 11 also includes a seat leaf 51 having an elongated, generally rectangular base 53. The seat leaf base 53 has a pair of apertures 71 formed therein for securing the seat leaf 51 to a toilet seat (not shown). As is shown in FIG. 8*a*, bottom plan view of a lid leaf 81, and in FIG. 9, an enlarged sectional view of the lid leaf 81, the apertures 101 are countersunk to form expanded apertures 103 to receive the heads of the fastening members (not shown). The apertures 71 in the seat leaf 51 are also countersunk (not shown).

Figure 10:
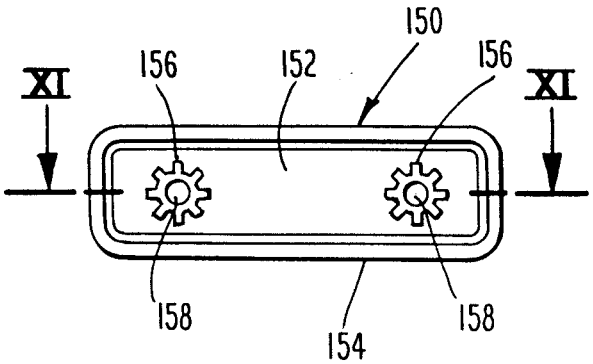
FIG. 10 is a bottom plan view of a bumper for use with the hinge of the present invention.
Figure 11:
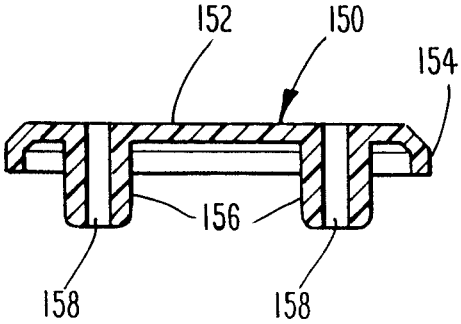
FIG. 11 is an elevational sectional view of the bumper of FIG. 10 taken along the line XI—XI.

FIGS. 10 and 11 illustrate a novel bumper 150 for use on toilet seats and toilet seat lids fitted with hinges of the present invention. As shown in the bottom plan view of FIG. 10, the bumper 150 has a body 152 with a generally rectangular shape. The bumper body 152 is provided with a downwardly directed skirt 154, at its exterior edge, as well as a pair of parallel, spaced, downwardly directed fluted pins 156 for press fitting the bumper 150 in a corresponding pair of blind apertures or holes provided in the underside of the toilet seat or toilet seat lid (not shown). In this context, "downwardly" means towards the toilet seat or toilet seat lid. Each fluted pin 156 is provided with an axial aperture 158 extending through the pin 156 and bumper body 152 to permit the pins 156 to be compressed as the pins 156 are press fit into the receiving apertures in the toilet seat or toilet seat lid. Preferably, the bumper is molded from a tough, resilient plastic material such as polyethylene.

Various other modifications can be made in the details of the embodiments of the hinge of the present invention, all within the spirit and scope of the invention as defined by the claims.

I claim:

1. A hinge for a toilet seat and lid, the hinge comprising:

(a) a bowl leaf having a base, means for securing the bowl leaf to a toilet bowl, and a pair of spaced apart socket portions extending upwardly from the forward end of the bowl leaf base;

(b) a seat leaf having a base, means for securing the seat leaf to a toilet seat, and a hinge pin receiving member extending upwardly from the rear end of the base and having a pair of parallel, generally flat sides, the hinge pin receiving member having a single slot formed therein for receiving a pair of hinge pins, a forward portion of the slot extending through the hinge pin receiving member from one side to the other side, and extending generally rearwardly and upwardly in the hinge pin receiving member, the slot being bound by a pair of generally parallel, generally flat walls and a generally semicylindrical wall, the hinge pin receiving member further comprising a hinge pin retaining member, the hinge pin retaining member extending from one of the generally flat walls of the slot and having a generally concave inner surface for rotatively securing the hinge pins, the hinge pin retaining member having generally triangular cross section in a plane parallel to the generally flat slot wall from which the hinge pin retaining member extends and defining sidewalls spaced inwardly from said flat sides of said receiving member, and (c) a lid leaf having a base, means for securing the lid leaf to a toilet seat lid, and a pair of hinge pin supports extending downwardly from the rear portion of the base, each hinge pin support having a pair of hinge pins extending laterally in opposite direction therefrom, the hinge pins having a common longitudinal axis.

2. A hinge according to claim 1 wherein the means for securing the bowl leaf to the towel bowl includes a generally T-shaped slot formed in the bottom of the bowl leaf base and extending generally parallel to the axis of the hinge pins.

3. A hinge according to claim 1 wherein the means for securing the seat leaf to the toilet seat includes at least two apertures formed in the seat leaf for receiving respective fastening members.

4. A hinge according to claim 3 wherein the means for securing the lid leaf to the toilet seat lid includes at least two apertures formed in the lid leaf for receiving respective fastening members.

5. A hinge according to claim 1 wherein the means for securing the seat leaf to the toilet seat includes at least two split compressible studs extending upwardly from the seat leaf base, the seat leaf studs lying in a line generally perpendicular to the axis of the hinge pins.

6. A hinge according to claim 5 wherein the means for securing the lid leaf to the toilet seat lid includes at least two split compressible studs extending upwardly from the base of the lid leaf, the lid leaf studs lying in a line generally parallel to the axis of the hinge pins.

7. A toilet seat assembly including a toilet seat, a toilet seat lid, and a hinge, the hinge comprising:

(a) a bowl leaf having a base, means for securing the bowl leaf to a toilet bowl, and a pair of spaced apart socket portions extending upwardly from the forward end of the bowl leaf base;

(b) a seat leaf having a base, means for securing the seat leaf to a toilet seat, and a hinge pin receiving member extending upwardly from the rear end of the base and having a pair of parallel, generally flat sides, the hinge pin receiving member having a single slot formed therein for receiving a pair of hinge pins, a formed portion of the slot extending through the hinge pin receiving member from one side to the other side, and extending generally rearwardly and upwardly in the hinge pin receiving member, the slot being bound by a pair of generally parallel, generally flat walls and a generally semicylindrical wall, the hinge pin receiving member further comprising a hinge pin retaining member, the hinge pin retaining member extending from one of the generally flat walls of the slot and having a generally concave inner surface for rotatively securing the hinge pins, the hinge pin retaining member having generally triangular cross section in a plane parallel to the generally flat slot wall from which the hinge pin retaining member extends and defining sidewalls spaced inwardly from said flat sides of said receiving member, and (c) a lid leaf having a base, means for securing the lid leaf to a toilet seat lid, and a pair of hinge pin supports extending downwardly from the rear portion of the base, each hinge pin support having a pair of hinge pins extending laterally in opposite direction therefrom, the hinge pins having a common longitudinal axis; and the toilet seat and the toilet seat lid each comprising at least one bumper, the at least one bumper including a generally rectangular body having a downwardly extending skirt extending from the exterior edge of the bumper body and at least two fluted pins extending downwardly from the bumper body for securing the bumper to the toilet seat or toilet seat lid by press fitting the pins into respective apertures, each fluted pin having an axial aperture extending therethrough and through the bumper body.

8. A toilet seat assembly according to claim 7, the toilet seat and the toilet seat lid each comprising at least one bumper, the at least one bumper including a generally rectangular body having downwardly extending skirt extending from the exterior edge of the bumper body and at least two fluted pins extending downwardly from the bumper body for securing the bumper to the toilet seat lid by press fitting the pins into respective apertures, each fluted pin having an axial aperture extending therethrough and through the bumper body.

* * * * *